US006307355B1

(12) United States Patent
Nguyen

(10) Patent No.: US 6,307,355 B1
(45) Date of Patent: Oct. 23, 2001

(54) METHOD AND APPARATUS FOR REDUCING THE POWER CONSUMPTION OF A VOLTAGE REGULATOR

(75) Inventor: Don J. Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/148,033

(22) Filed: Sep. 3, 1998

(51) Int. Cl.[7] ..... G05F 1/56
(52) U.S. Cl. ..... 323/271; 323/282
(58) Field of Search ..... 323/271, 282, 323/283, 351

(56) References Cited

U.S. PATENT DOCUMENTS 3,978,393 * 8/1976 Wisner et al. ..... 323/272
4,395,675 * 7/1983 Toumani ..... 323/271
5,481,178 * 1/1996 Wilcox et al. ..... 323/287
5,627,460 * 5/1997 Bazinet et al. ..... 323/288
5,777,461 * 7/1998 Massie et al. ..... 323/282

* cited by examiner

*Primary Examiner*—Adolf Denske Berhane
(74) *Attorney, Agent, or Firm*—Blakely, Sokoloff, Taylor & Zafman LLP

(57) ABSTRACT

A voltage regulator illustrating one embodiment of the apparatus of the present invention is described. The voltage regulator includes an output stage for providing an output voltage on an output voltage terminal, a first switch for charging the output stage, and a second switch for discharging output stage 201. The voltage regulator also includes an input signal terminal for receiving a control signal and a third switch for preventing the second switch from closing when the control signal is asserted. When the control signal on the input signal terminal is not asserted, the voltage regulator operates as a typical switching regulator, alternately charging and discharging the output stage to maintain a stable output voltage on the output voltage terminal. A portion of the power supplied to charge the output stage is consumed every time the output stage is discharged. However, when the control signal on the input terminal is asserted, the second switch is prevented from closing, so the output stage is not discharged through the second switch. Therefore, the power consumption of the voltage regulator is reduced.

26 Claims, 5 Drawing Sheets

METHOD AND APPARATUS FOR REDUCING THE POWER CONSUMPTION OF A VOLTAGE REGULATOR

FIELD OF THE INVENTION

The present invention relates to the field of voltage regulators and more particularly to the field of power management of voltage regulators.

BACKGROUND OF THE INVENTION

An important objective in the design of many electronic systems is to reduce or limit power consumption. For example, most portable computers are designed with the capability to employ one or more power management techniques to extend battery life. One such power management technique is to remove power from an electronic device within the portable computer when that device is expected to be idle for a certain period of time. At least two approaches to removing power from a specific electronic device in a portable computer have been used. These two approaches are illustrated in FIGS. 1*a* and 1*b*.

FIG. 1*b* is a simplified block diagram of portable computer 100 including power supply 101, voltage regulator 102, electronic device 103, and power management controller 104. Electronic device 103 receives a stable supply voltage through voltage input terminal 105. Voltage regulator 102 provides the stable supply voltage on output voltage terminal 106. Voltage input terminal 107 of voltage regulator 102 is coupled through switch 108 to power supply output terminal 109 of power supply 101. Switch 108 is controlled by power management controller 104 such that power is removed from voltage regulator 102, and therefore from electronic device 103, when a control signal provided on control signal output terminal 110 is asserted.

One problem with the approach illustrated in FIG. 1*a* is that the time required to restore the stable supply voltage to electronic device 103 includes a delay between the time that power is restored to voltage regulator 102 and the time that voltage regulator 102 provides a stable supply voltage on output voltage terminal 106. This delay typically includes the time required to charge an output capacitor within voltage regulator 102. This problem can be avoided with the approach illustrated in FIG. 1*b*.

FIG. 1*b* is a simplified block diagram of portable computer 150 including power supply 151, voltage regulator 152, electronic device 153, and power management controller 154. Electronic device 153 receives a stable supply voltage through voltage input terminal 155. Voltage regulator 152 provides the stable supply voltage on output voltage terminal 156. Voltage input terminal 157 of voltage regulator 152 is coupled to power supply output terminal 158 of power supply 151. Switch 159 is controlled by power management controller 154 such that power is removed from electronic device 153, but not voltage regulator 152, when a control signal provided on control signal output terminal 160 is asserted.

One problem with the approach illustrated in FIG. 1*b* is that voltage regulator 152 continues to consume power even when electronic device 153 is idle. In response to this problem, a novel approach to reducing the power consumption of a voltage regulator has been developed.

SUMMARY OF THE INVENTION

A voltage regulator having an output stage for providing an output voltage, a first switch for charging the output stage, and a second switch for discharging the output stage is disclosed. The voltage regulator also includes an input terminal for receiving a control signal and a third switch for preventing the second switch from closing when the control signal is asserted.

DETAILED DESCRIPTION OF A PREFERRED EMBODIMENT

A method and apparatus for reducing the power consumption of a voltage regulator is described. In the following description, specific details are set forth in order to provide a thorough understanding of the present invention. It will be apparent, however, to one skilled in the art that the present invention can be practiced without regard to these specific details. In other instances, well known concepts have not been described in particular detail in order to avoid obscuring the present invention.

Figure 1A:
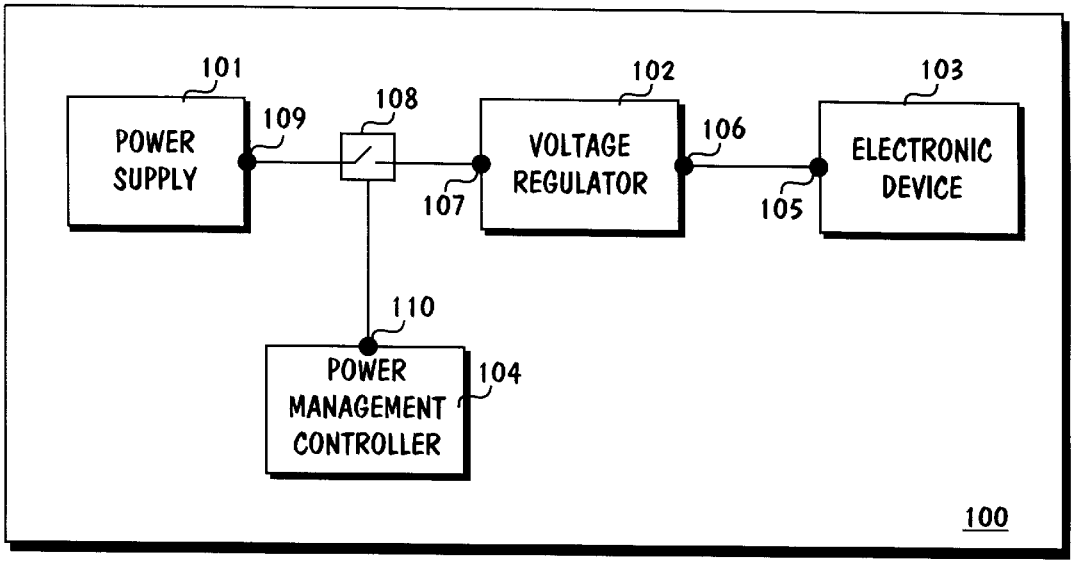
FIG. 1a (PRIOR ART)
FIG. 1*a* is a simplified block diagram illustrating a first prior approach to removing power from an electronic device in a portable computer.
Figure 1B:
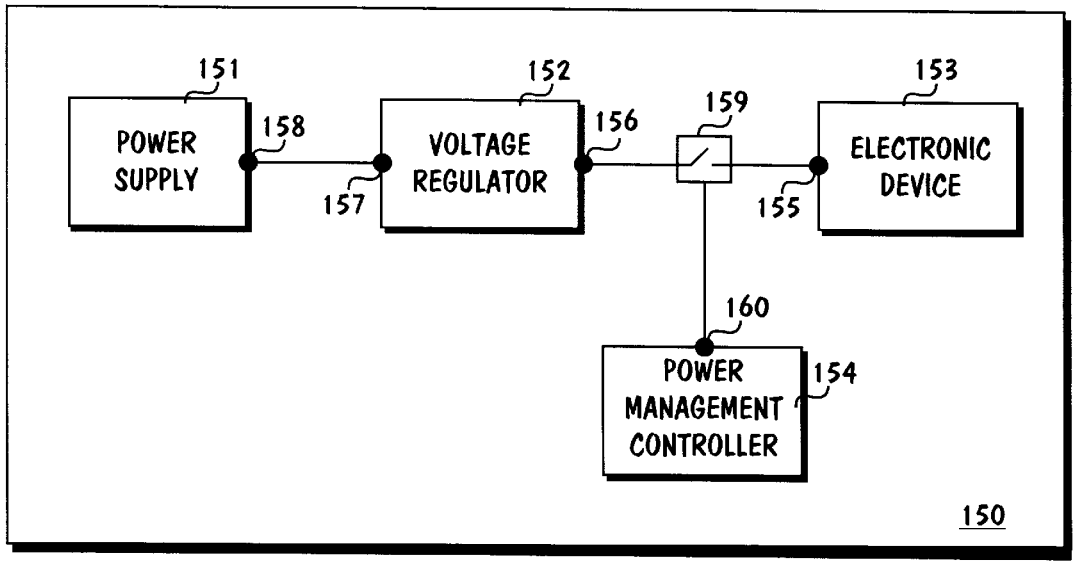
FIG. 1b (PRIOR ART)
FIG. 1*b* is a simplified block diagram illustrating a second prior approach to removing power from an electronic device in a portable computer.
Figure 2:
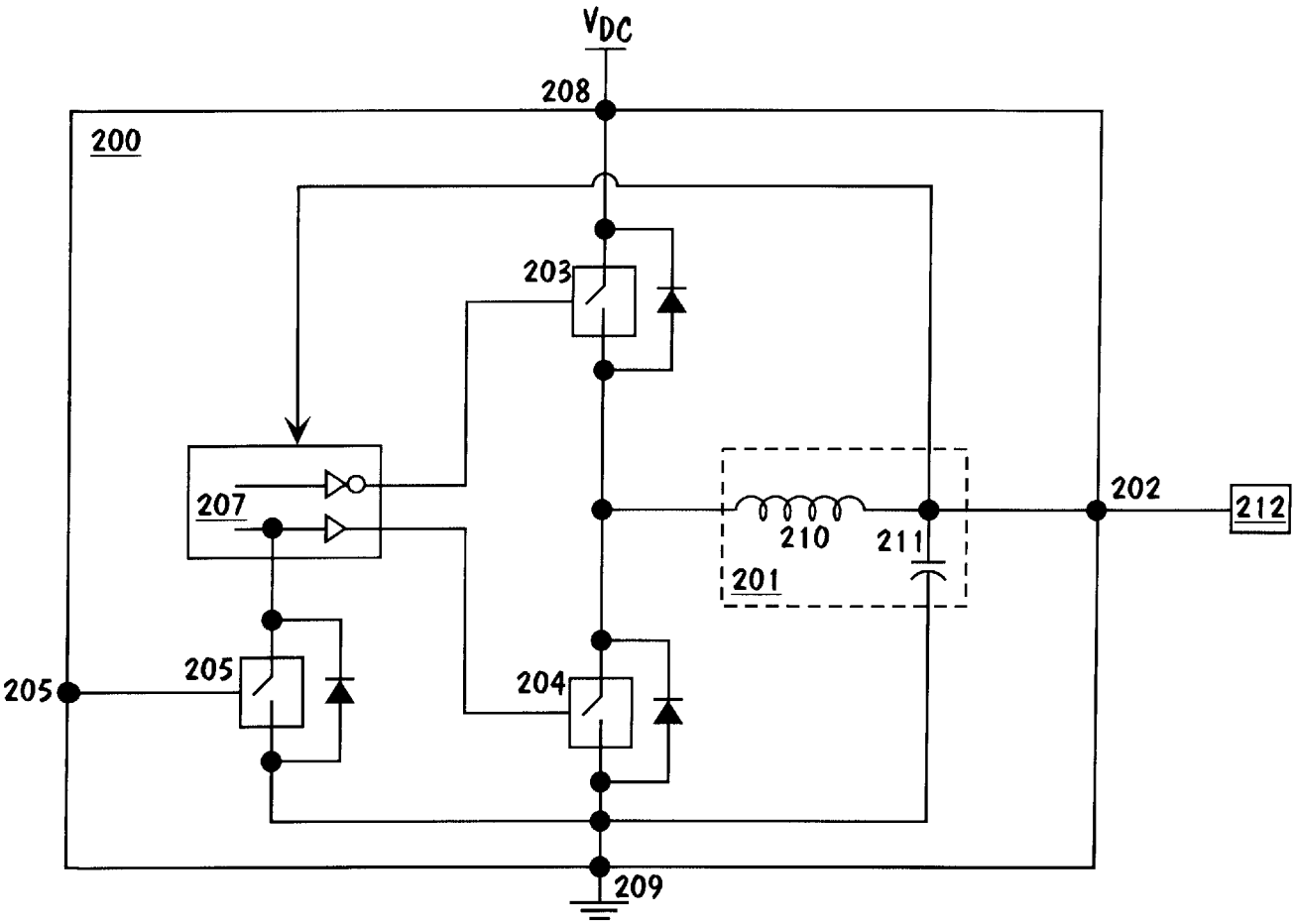
FIG. 2 is a block diagram of a voltage regulator illustrating one embodiment of the apparatus of the present invention.

FIG. 2 is a block diagram of voltage regulator 200 illustrating one embodiment of the apparatus of the present invention. Voltage regulator 200 includes output stage 201 for providing an output voltage on output voltage terminal 202, switch 203 for charging output stage 201, and switch 204 for discharging output stage 201. Voltage regulator 200 also includes input signal terminal 205 for receiving a control signal and switch 206 for preventing switch 204 from closing when the control signal is asserted.

When the control signal on input signal terminal 205 is not asserted, voltage regulator 200 operates as a typical switching regulator, alternately charging and discharging output stage 201 to maintain a stable output voltage on output voltage terminal 202. A portion of the power supplied to charge output stage 201 is consumed every time output stage 201 is discharged. However, when the control signal on input terminal 205 is asserted, switch 204 is prevented from closing, so output stage 201 is not discharged through switch 204. Therefore, the power consumption of voltage regulator 200 is reduced.

In the embodiment of FIG. 2, output stage 201 includes inductor 210 and capacitor 211 for generating and storing charge to maintain the output voltage on output voltage terminal 202. The output voltage on output voltage terminal 202 is fed back to controller 207, which controls the charging and discharging of output stage 201 according to any well known technique. Voltage regulator 200 also includes input voltage terminal 208, coupled to DC voltage source $V_{DC}$ in this embodiment, and input voltage terminal 209, coupled to ground in this embodiment. Terminals 202, 205, 208, 209, and any other terminals described in the present invention can comprise any electronic connector, such as but not limited to a pin, pad, or solder bump.

In one embodiment, controller 207 controls switches 203 and 204 in order to maintain the stability of the output voltage on output voltage terminal 202. For example, when the primary output voltage is below a desired potential, controller 206 causes switch 203 to close or remain closed such that primary output voltage terminal 202 is coupled to $V_{DC}$ through inductor 210, and causes switch 204 to open or remain open. With switch 203 closed and switch 204 open, current flows through inductor 210 to charge capacitor 211 and supply current to load 212 coupled to output voltage terminal 202.

If the control signal on input signal terminal 205 is not asserted, then after the output voltage on output voltage terminal 202 rises to the desired potential, controller 207 causes switch 203 to open and switch 204 to close, such that output voltage terminal 202 is coupled to ground through inductor 210. Then, the potential difference induced across inductor 210 causes current to continue flowing through inductor 210 towards output voltage terminal 202, until the output voltage on output voltage terminal 202 again falls below the desired potential and output stage 201 is recharged.

If, instead, the control signal on input signal terminal 205 is asserted, then after the output voltage on output voltage terminal 202 rises to the desired potential, controller 207 causes switch 203 to pen but switch 204 is prevented from closing. Output voltage terminal 202 is not coupled to ground through inductor 210, so output stage 210 is not discharged through switch 204. Therefore, the output voltage on output voltage terminal 202 will remain at or above the desired potential for a longer period of time than if output stage 201 were being discharged through switch 204. Consequently, output stage is recharged less frequently, and the power consumption of voltage regulator 200 is reduced.

The control signal on input signal terminal 205 can be used to indicate a condition of load 212. In one embodiment, the condition can be that load 212 requires a supply current above a certain level. In another embodiment, the condition can be that load 212 requires a stable supply voltage. In another embodiment, the condition can be that load 212 is in an active state, as opposed to an idle state. When the condition exists, the control signal on input signal terminal 204 can be deasserted such that switch 204 can close to discharge output stage 201 and thereby prevent the output voltage on output voltage terminal 202 from rising or remaining above the desired potential. When the condition does not exist, the control signal on input signal terminal 204 can be asserted such that switch 204 cannot close, thereby reducing the power consumption of voltage regulator 200. By dynamically controlling voltage regulator 200 based on the condition of load 212, the total power consumption of voltage regulator 200 can be reduced.

Figure 3:
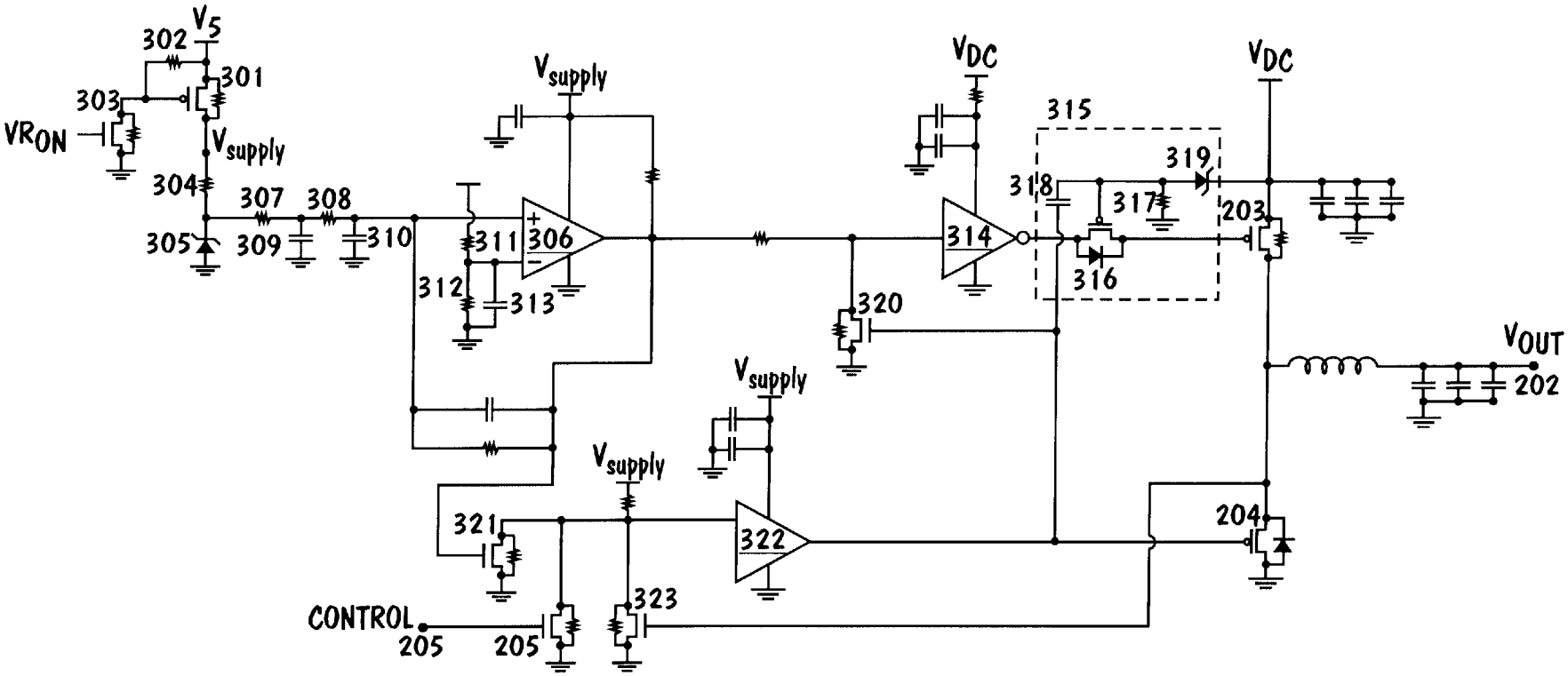
FIG. 3 is a circuit diagram illustrating one embodiment of the present invention.

FIG. 3 is a circuit diagram illustrating one embodiment of voltage regulator 200. In the embodiment of FIG. 3, switches 203, 204, and 206 are metal-oxide-semiconductor field effect transistors (MOSFETs). More specifically, switch 203 is a P channel MOSFET and switches 204 and 206 are N channel MOSFETs. However, switches 203, 204, and 206 can be any other type of switch, such as, but not limited to junction FETs or bipolar transistors.

In FIG. 3, 5V voltage source $V_5$ is connected to the source of transistor 301. Resistor 302 is connected between the source and gate of transistor 301. The gate of transistor 301 is also connected to the drain of transistor 303. The source of transistor 303 is connected to ground, and the gate of transistor 303 is connected to a signal $VR_{ON}$, which, when asserted, causes the generation of supply voltage $V_{supply}$ at the drain of transistor 301.

Supply voltage $V_{supply}$ is connected to one terminal of resistor 304. The cathode of voltage reference diode 305 is connected to the other terminal of resistor 304 and the anode of voltage reference diode 305 is connected to ground, resulting in a predetermined reference voltage at the cathode of voltage reference diode 305. In this embodiment, voltage reference diode 305 is an LM4041 bandgap reference diode.

The cathode of voltage reference diode 305 is also connected to the positive input terminal of comparator 306 through a time delay circuit including resistors 307 and 308 and capacitors 309 and 310. The output voltage is connected to the negative input terminal of primary comparator 306 through a voltage divider including resistors 311 and 312 and capacitor 313. In this embodiment, comparator 306 is an LM339 quad comparators powered by supply voltage $V_{supply}$.

The output of comparator 306 is connected to the input of inverting driver 314. The output of inverting driver 314 is connected to the input of level shifter 315 which includes transistor 316, resistor 317, capacitor 318, and diode 319. Level shifter 315 is used to control the gate to source voltage of the P channel MOSFET switch 203. The output of level shifter 315 controls switch 203. The input of inverting driver 314 is also connected to the drain of safety transistor 320, whose gate is connected to the gate of switch 204 such that switch 203 does not close unless switch 204 is open. In this embodiment, inverting driver 314 is a TC4431 inverting CMOS driver powered by voltage source $V_{DC}$.

The output of comparator 306 is also connected to the gate of transistor 321. The drain of transistor 321 is connected to the input of noninverting driver 322. The output of noninverting driver 322 controls switch 204. The input of noninverting driver 322 is also connected to the drain of safety transistor 323, whose gate is connected to the drain of switch 203 such that switch 204 does not close unless switch 203 is open. In this embodiment, noninverting driver 322 is a TC4412 noninverting CMOS driver powered by supply voltage $V_{supply}$.

Comparator 306 is used to determine whether the output voltage on output terminal 202 is above or below a desired potential. If the output voltage is below the desired potential, the voltage on the positive input terminal of comparator 306 is greater than the voltage on the negative input terminal of comparator 306, so the output of comparator 306 is driven or remains high. Then, the output of inverting driver 314 is driven or remains low, and P channel MOSFET switch 203 is closed or remains closed. Also, the output of noninverting driver 322 is driven or remains low, and N channel MOSFET switch 204 is opened or remains open.

On the other hand, if the output voltage is above the desired potential, the voltage on the positive input terminal of comparator 306 is less than the voltage on the negative input terminal of comparator 306, so the output of comparator 306 is driven or remains low. Then, the output of inverting driver 314 is driven or remains high, and P channel MOSFET switch 203 is opened or remains opened. Also, assuming that the control signal on input signal terminal 205 is an active high signal and is not asserted, the output of noninverting driver 322 is driven or remains high and N channel MOSFET switch 204 is closed or remains closed. However, assuming that the control signal on input signal terminal 205 is still an active high signal but is now asserted, the output of noninverting driver 322 is driven or remains low and N channel MOSFET switch 204 is open or remains open.

Figure 4A:
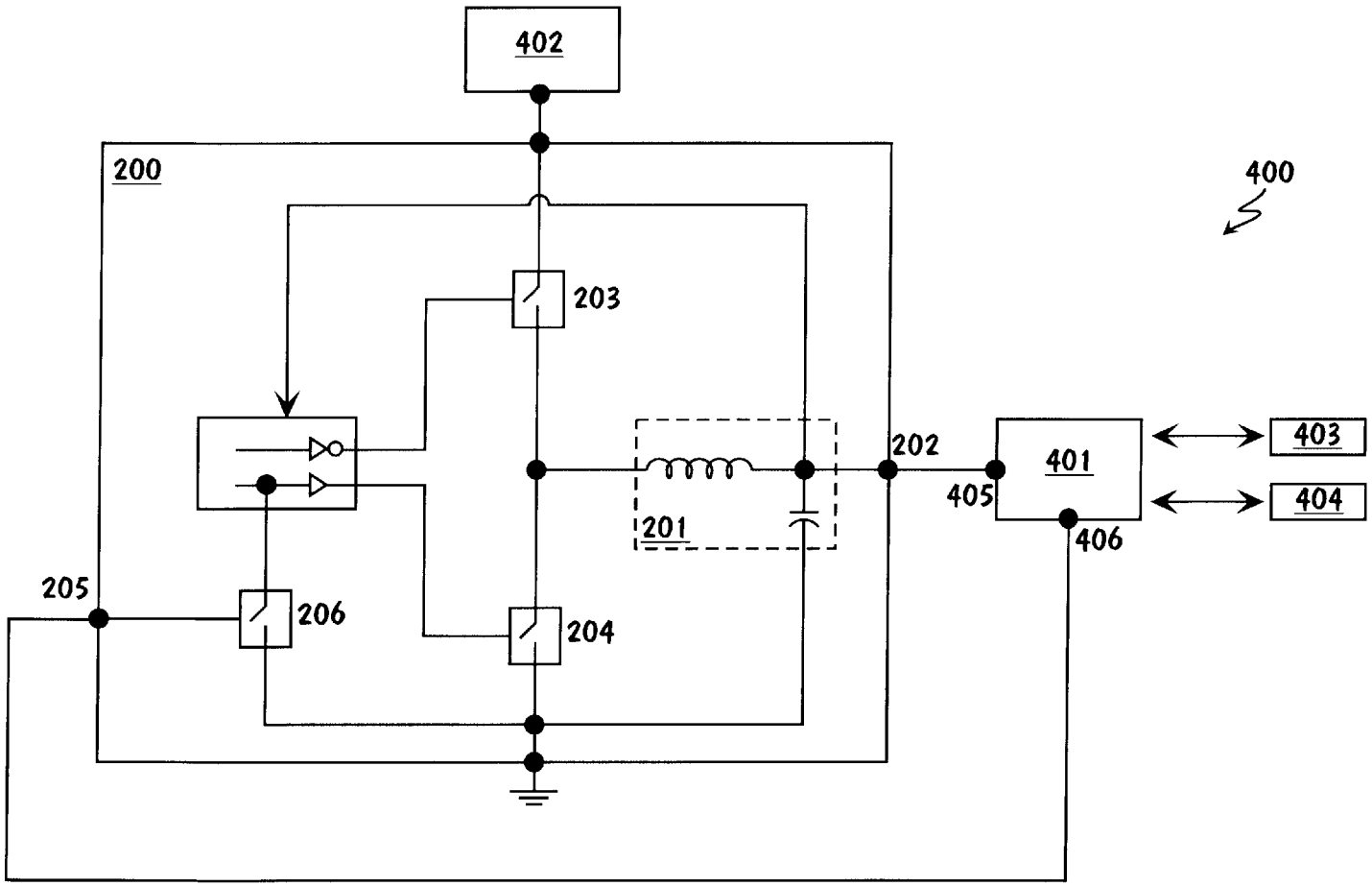
FIG. 4*a* is a block diagram illustrating one embodiment of the present invention in an electronic system.

FIG. 4*a* is a simplified block diagram illustrating an embodiment of the apparatus of the present invention in electronic system 400. Electronic system 400 includes voltage regulator 200 and electronic device 401. In this embodiment, electronic system 400 is a computer system and electronic device 401 is a microprocessor. However, electronic device 401 can be any integrated circuit or any other electronic device. Computer system 400 can also include other components, such as DC voltage source 402, memory 403, and input/output device 404. Voltage regulator 200 includes output stage 201, input signal terminal 205, and switches 203, 204, and 206 as described above.

Microprocessor 401 in computer system 400 includes input voltage terminal 405 for receiving a supply voltage from voltage regulator 200. Microprocessor 401 also includes output signal terminal 406 for providing a control signal to indicate a condition of microprocessor 401. In one embodiment, microprocessor 401 asserts the control signal on output signal terminal 406 when microprocessor 401 is idle. The definition and determination of when microprocessor 401 is idle can vary according to system hardware design, system software design, and/or user activities or preferences. In one embodiment, microprocessor 401 becomes idle when it has not executed any instructions after a certain period of time. In another embodiment, microprocessor 401 is idle when a clock signal within microprocessor 401 is stopped. In another embodiment, microprocessor 401 becomes idle when a specific event occurs based on user or other input to computer system 400. Many other approaches to determining when the control signal on output signal terminal 406 is asserted are possible within the scope of the present invention.

Output signal terminal 406 of microprocessor 401 is coupled to input signal terminal 205 of voltage regulator 200, such that microprocessor 401 can dynamically control voltage regulator 200 based on a condition of microprocessor 401. Therefore, the total power consumption of voltage regulator 200 in electronic system 400 can be reduced.

Figure 4B:
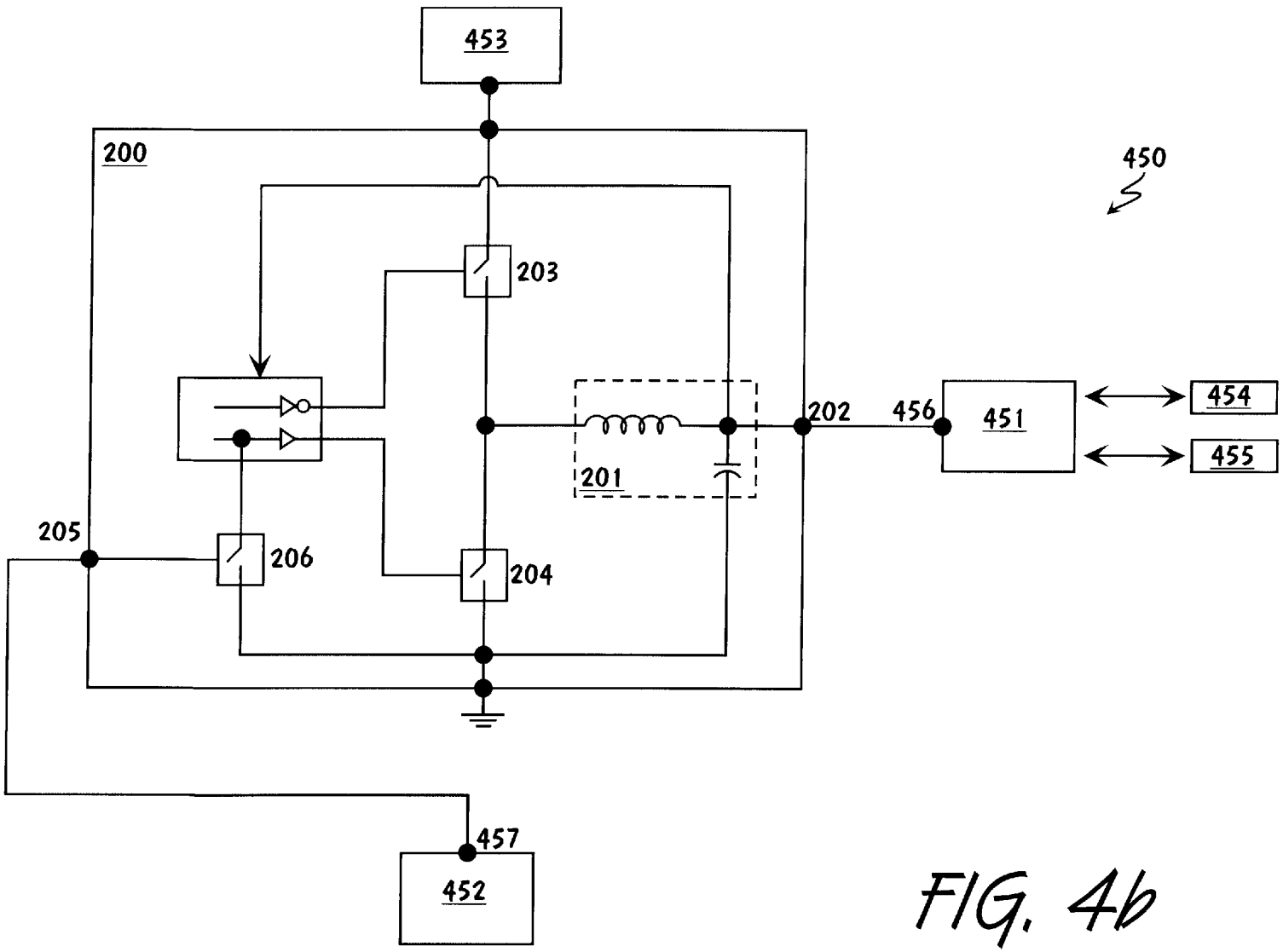
FIG. 4*b* is a block diagram illustrating another embodiment of the present invention in an electronic system.

FIG. 4*b* is a simplified block diagram illustrating another embodiment of the apparatus of the present invention, here in electronic system 450. Electronic system 450 includes voltage regulator 200, electronic device 451, and electronic device 452. In this embodiment, electronic system 450 is a computer system, electronic device 451 is a microprocessor, and electronic device 452 is a power management controller. However, electronic devices 451 and 452 can be any integrated circuits or any other electronic devices. Computer system 450 can also include other components, such as DC voltage source 453, memory 454, and input/output device 455. Voltage regulator 200 includes output stage 201, input signal terminal 205, and switches 203, 204, and 206 as described above.

Microprocessor 451 in computer system 450 includes input voltage terminal 456 for receiving a supply voltage from voltage regulator 200. Power management controller 452 in computer system 450 includes output signal terminal 457 for providing a control signal to indicate a condition of microprocessor 451. Power management controller 452 can assert the control signal on output signal terminal 457 according to any approach desired, including those approaches described above in conjunction with computer system 400.

Output signal terminal 457 of power management controller 452 is coupled to input signal terminal 205 of voltage regulator 200, such that power management controller 452 can dynamically control voltage regulator 200 based on a condition of microprocessor 451. Therefore, the total power consumption of voltage regulator 200 in electronic system 450 can be reduced.

Thus, the exemplary embodiments of the present invention illustrated by FIGS. 2, 3, 4*a,* and 4*b* have been described. However, the invention is not limited to these embodiments or any of the details described. The specification and drawings must be regarded in an illustrative rather than a restrictive sense. The scope of the invention is defined by the following claims.

What is claimed is:

1. A voltage regulator comprising:

an output stage for providing an output voltage;

a first switch for charging said output stage;

a second switch for discharging said output stage;

an input terminal for receiving a control signal; and a third switch for preventing said second switch from closing when said control signal is asserted.

2. The voltage regulator of claim 1 further comprising a fourth switch for preventing said second switch from closing when said first switch is closed.

3. A voltage regulator comprising:

an output stage for providing an output voltage;

a first switch for charging said output stage;

a second switch for discharging said output stage;

an input terminal for receiving a control signal; and means for preventing said second switch from closing when said control signal is asserted.

4. The voltage regulator of claim 3 further comprising a fourth switch for preventing said second switch from closing when said first switch is closed.

5. A voltage regulator comprising:

a first input voltage terminal;

a second input voltage terminal;

an output voltage terminal for providing an output voltage;

an inductor having a first terminal and a second terminal, said first terminal being coupled to said output voltage terminal;

a first switch coupled between said first input voltage terminal and said second terminal of said inductor;

a second switch coupled between said second input voltage terminal and said second terminal of said inductor;

an input signal terminal for receiving a control signal; and a third switch for preventing said second switch from closing when said control signal is asserted.

6. The voltage regulator of claim 5 wherein each of said first, second, and third switches comprises a MOSFET.

7. The voltage regulator of claim 5 wherein:

the gate of said third switch is coupled to said input signal terminal; and the drain of said third switch is coupled to the gate of said second switch.

8. The voltage regulator of claim 5 further comprising a fourth switch for preventing said second switch from closing when said first switch is closed.

9. The voltage regulator of claim 8 wherein each of said first, second, third, and fourth switches comprises a MOSFET.

10. The voltage regulator of claim 9 wherein:

the gate of said third switch is coupled to said input signal terminal;

the drains of said third and fourth switches are coupled to the gate of said second switch; and the gate of said fourth switch is coupled to said second terminal of said inductor.

11. The voltage regulator of claim 10 wherein said first switch comprises a P channel MOSFET and each of said second, third, and fourth switches comprises an N channel MOSFET.

12. The voltage regulator of claim 11 further comprising a comparator having a first input coupled to said output voltage, a second input coupled to a reference voltage, and an output coupled to the gate of said first switch.

13. A voltage regulator comprising:

a first input voltage terminal;

a second input voltage terminal;

an output voltage terminal for providing an output voltage;

an inductor having a first terminal and a second terminal, said first terminal being coupled to said output voltage terminal;

a first switch coupled between said first input voltage terminal and said second terminal of said inductor;

a second switch coupled between said second input voltage terminal and said second terminal of said inductor;

an input signal terminal for receiving a control signal; and means for preventing said second switch from closing when said control signal is asserted.

14. The voltage regulator of claim 13 further comprising a fourth switch for preventing said second switch from closing when said first switch is closed.

15. The voltage regulator of claim 14 wherein said first switch comprises a MOSFET, said voltage regulator further comprising a comparator having a first input coupled to said output voltage, a second input coupled to a reference voltage, and an output coupled to the gate of said first switch.

16. An electronic system comprising:

a first electronic device having an input voltage terminal for receiving a supply voltage;

a second electronic device having an output signal terminal for providing a control signal to indicate a condition of said first electronic; and a voltage regulator comprising:

an output stage for providing said supply voltage to said first electronic device;

a first switch for charging said output stage;

a second switch for discharging said output stage;

an input signal terminal for receiving said control signal; and a third switch for preventing said second switch from closing when said control signal is asserted.

17. The electronic system of claim 16 wherein said second electronic device has said output signal terminal for providing said control signal to indicate the condition that said first electronic device requires a supply current above a certain level.

18. The electronic system of claim 16 wherein said second electronic device has said output signal terminal for providing said control signal to indicate the condition that said first electronic device requires a stable supply voltage.

19. The electronic system of claim 16 wherein said second electronic device has said output signal terminal for providing said control signal to indicate the condition that said first electronic device is in an active state.

20. An electronic system comprising:

an electronic device comprising:

an input voltage terminal for receiving a supply voltage; and an output signal terminal for providing a control signal to indicate a condition of said electronic device; and a voltage regulator comprising:

an output stage for providing said supply voltage to said electronic device;

a first switch for charging said output stage;

a second switch for discharging said output stage;

an input signal terminal for receiving said control signal; and a third switch for preventing said second switch from closing when said control signal is asserted.

21. The electronic system of claim 20 wherein said electronic device has said output signal terminal for providing said control signal to indicate the condition that said electronic device requires a supply current above a certain level.

22. The electronic system of claim 20 wherein said electronic device has said output signal terminal for providing said control signal to indicate the condition that said electronic device requires a stable supply voltage.

23. The electronic system of claim 20 wherein said electronic device has said output signal terminal for providing said control signal to indicate the condition that said electronic device is in an active state.

24. The electronic system of claim 20 wherein said electronic device is a microprocessor and said microprocessor asserts said control signal when said microprocessor is idle.

25. A method of reducing the power consumption of a voltage regulator providing a supply voltage to an electronic device, said method comprising:

asserting a control signal to indicate a condition of said electronic device; and using said asserted control signal to prevent an output stage of said voltage regulator from discharging.

26. The method of claim 25 when the step of using said asserted control signal to prevent an output stage of said voltage regulator from discharging includes a step of using said asserted control signal to prevent a switch for discharging said output stage from closing.

* * * * *